US005897244A

United States Patent [19]

Miyazaki et al.

[11] Patent Number: 5,897,244

[45] Date of Patent: Apr. 27, 1999

[54] IMAGE-FORMING MACHINE CAPABLE OF OPENING TO PERMIT READY ACCESS TO INTERNAL COMPONENTS

[75] Inventors: Masahiko Miyazaki; Yoshifumi Okauchi; Naoyuki Ishida; Yukihiro Ito; Tetsuya Ichigotani; Shoji Hirano; Takahisa Nakaue, all of Osaka, Japan

[73] Assignee: Mita Industrial Co., Ltd., Osaka, Japan

[21] Appl. No.: 08/971,622

[22] Filed: Nov. 17, 1997

[30] Foreign Application Priority Data

Nov. 16, 1996 [JP] Japan ..... 8-320777
Nov. 16, 1996 [JP] Japan ..... 8-320780

[51] Int. Cl.[6] ..... G03G 15/00

[52] U.S. Cl. ..... 399/122; 399/124; 399/325

[58] Field of Search ..... 399/107, 122, 399/124, 325, 381, 110; 347/138, 152, 170; 358/296, 300, 498

[56] References Cited

U.S. PATENT DOCUMENTS 5,172,238 12/1992 Kuboki ..... 358/296
5,337,134 8/1994 Sato et al. ..... 399/124
5,745,246 4/1998 Takaki et al. ..... 358/296

*Primary Examiner*—Joan Pendegrass
*Attorney, Agent, or Firm*—Antonelli, Terry, Stout & Kraus, LLP

[57] ABSTRACT

An image-forming machine has a sheet member conveying passage extending through a transfer zone and a fixing zone, a sheet member-feeder for feeding a sheet member to the sheet member conveying passage, and a sheet member conveyor for conveying the sheet member through the sheet member conveying passage. A housing of the image-forming machine has a lower surface defined by an intermediate lower wall and an upper surface defined by an intermediate upper wall, and has a space of which the front surface is opened. The downstream end portion of the sheet member conveying passage extends along one side portion of the intermediate lower wall on the lower side thereof. That one side portion of the intermediate lower wall is defined by an opening/closing member which is brought to the open position to open the downstream end portion of the sheet member conveying passage. The sheet member conveyer includes a pair of register rollers. After the leading edge of the sheet member delivered to the sheet member conveying passage is brought into contact with the nip of the pair of register rollers, the pair of register rollers are preliminarily rotated for only a predetermined period of time.

7 Claims, 6 Drawing Sheets

IMAGE-FORMING MACHINE CAPABLE OF OPENING TO PERMIT READY ACCESS TO INTERNAL COMPONENTS

FIELD OF THE INVENTION

The present invention relates to an image-forming machine such as a copier, a printer or a facsimile and, particularly, to an image-forming machine called a composite machine having the functions of a copier, a printer and a facsimile, though the invention is not limited thereto.

DESCRIPTION OF THE PRIOR ART

As is well known, an image-forming machine is equipped with a sheet member conveying passage that extends through a transfer zone and a fixing zone, a sheet member-feeding means for feeding a sheet member, which may be common paper, to the sheet member conveying passage, a sheet member conveying means for conveying the sheet member through the sheet member conveying passage, and a sheet member-receiving means for receiving the sheet member discharged from the sheet member conveying passage. There are further disposed a toner image carrier means, a toner image-forming means for forming a toner image on the toner image carrier means, a transfer means for transferring the toner image from the toner image carrier means onto the sheet member in the transfer zone, and a fixing means for fixing the toner image on the sheet member in the fixing zone.

When the image-forming machine is a composite machine, in general, the toner image carrier means is constituted by a rotary drum having an electrostatic photosensitive material disposed on the peripheral surface thereof, and the toner image-forming means includes a laser beam irradiation means and a developing means. The laser beam irradiation means selectively irradiates a laser beam onto the peripheral surface of the toner image carrier means, so that an electrostatic latent image is formed on the toner image carrier means, and the developing means develops the electrostatic latent image on the toner image carrier means into a toner image. The image-forming machine is further provided with a document reading means. When the image-forming machine is used as a copier, the laser beam irradiation means is controlled for its operation based on image signals that represent a document image read by the document reading means, and an electrostatic latent image corresponding to the document image is formed on the toner image carrier means. When the image-forming machine is used as a printer, the laser beam irradiation means is controlled for its operation based on image signals transmitted from a personal computer or the like, and an electrostatic latent image corresponding to the image to be printed is formed on the toner image carrier means. When the image-forming machine is used as a facsimile for transmission, image signals representing the document image read by the document reading means are transmitted to another facsimile machine. When the image-forming machine is used as a facsimile for reception, the laser beam irradiation means is controlled for its operation based on image signals received from another facsimile machine, and an electrostatic latent image corresponding to the received image signals is formed on the toner image carrier means.

When the image-forming machine is a composite machine, in particular, it has been proposed to provide a housing for the image-forming machine having a lower surface defined by an intermediate lower wall and an upper surface defined by an intermediate upper wall in an intermediate portion of the housing, and having a space of which at least the front surface can be opened, in order to realize the image-forming machine in a very compact size. The sheet member-feeding means is disposed at a lower end portion of the housing to feed the sheet members onto the sheet member conveying passage. The sheet member-receiving means for receiving the sheet members discharged from the sheet member conveying passage is constituted by a portion of the intermediate lower wall or, more specifically, by a portion of the intermediate lower wall excluding one side portion. The document reading means is disposed above the intermediate upper wall.

In the image-forming machine using a housing of the above-mentioned form, the sheet member conveying passage must extend upwardly from its upstream end neighboring the sheet member-feeding means to its downstream side in the fixing zone along one side wall of the housing and must, then, extend in a direction to separate away from the one side wall via a curved portion along the one side portion of the intermediate lower wall under the one side portion. However, the sheet member conveying passage that is formed as described above has the following problems.

Firstly, concerning a portion located upstream of the fixing zone in the sheet member conveying passage, it is possible to define a portion of one side wall of the housing by an opening/closing member that can move between a closed position and an open position without any problem. When the opening/closing member is brought to the closed position, the sheet member conveying passage is defined. When the opening/closing member is brought to the open position, the sheet member conveying passage is opened. In this constitution, when sheet members are jammed in a portion on the upstream side of the fixing zone in the sheet member conveying passage, the opening/closing member is opened and the sheet member conveying passage is opened, so that the jammed sheet members can be taken out very easily. Concerning the downstream end portion in the sheet member conveying passage, however, when the portion of the one side wall of the housing and the one side portion of the intermediate lower wall are defined by a common opening/closing member that is opened toward one side of the housing, the opening/closing member that must be moved to the one side of the housing is likely to be considerably large in size. Therefore, a considerably large space must be formed on one side of the housing, and a considerably large place is required for installing the image-forming machine. It also becomes necessary to form a considerably large space for opening the one side portion of the intermediate lower wall on one side of the housing over the one side portion of the intermediate lower wall, resulting in a considerable increase in the total height of the image-forming machine.

The fixing means for fixing the toner image on the sheet member in the fixing zone is usually constituted by a pair of fixing rollers which are pushed toward each other with a considerable pressure. In such a case, even when the opening/closing member is brought to the open position, it is desired that the pair of fixing rollers be maintained in a state of being pushed toward each other. When one of the pair of fixing rollers is mounted on the opening/closing member so as to move together with the opening/closing member, it becomes necessary to move the opening/closing member against the pushing force of the pair of fixing rollers. Accordingly, it becomes considerably difficult to move the opening/closing member. When the opening/closing member is repetitively moved, furthermore, the force pushing the pair of fixing rollers undergoes a change, and the fixing action is deteriorated.

Secondly, when the fixing means is constituted by a pair of fixing rollers, one of the pair of fixing rollers, i.e., the roller acting on the surface of the sheet member on which is formed a toner image that is to be fixed, must be provided with a peeling agent application means for suitably applying a peeling agent such as a silicone oil. Such a peeling agent application means is usually constituted by a support member and an application member mounted on the lower end of the support member, and the application member is formed of a material such as felt that can be impregnated with the peeling agent. The peeling agent application means must be renewed when the peeling agent contained in the application member is depleted. In the conventional image-forming machines, however, renewal of the peeling agent application means is not necessarily easy.

Thirdly, the sheet member-feeding means is constituted by a sheet member accommodation means for accommodating sheet members in a stacked state and a rotary delivery means for delivering the uppermost sheet member of the stacked sheet members onto the sheet member conveying passage. The sheet member accommodation means can be constituted by a cassette container detachably mounted at a predetermined position. It is desired from a viewpoint of the cost of production and the like that the rotary delivery member have an arcuate acting surface that acts on the uppermost sheet member and a non-acting surface that is separated away from the uppermost sheet member. Further, a pair of register rollers are disposed in the sheet member conveying passage. The rotary delivery means in the sheet member-feeding means is turned once from a stop position at which the non-acting surface is opposed to the uppermost sheet member, and in this turn, the arcuate acting surface acts on the uppermost sheet member so that it is delivered to the sheet member conveying passage, and the leading edge of the sheet member comes into contact with the nip of the pair of register rollers that remain at rest. Even when the sheet member is delivered in a slightly skewed manner onto the sheet member conveying passage, the leading edge of the sheet member comes into contact with the nip of the pair of register rollers which are at rest, and the skewed state of the sheet member is corrected. As described above, however, when the sheet member conveying passage is upwardly extending from the upstream end to the downstream end of the fixing zone along one side wall of the housing, i.e., when the upstream portion of the sheet member upwardly extends toward the pair of register rollers, the leading edge of the sheet member is brought into contact with the nip of the pair of register rollers that are at rest and, thereafter, the rotary delivery member rotates once so that the non-acting surface is opposed to the sheet member. Then, as the rotary delivery member separates away from the sheet member, the sheet member that is delivered slightly moves back due to its own weight and its leading edge tends to be moved back from the nip of the pair of register rollers. When the leading edge of the delivered sheet member moves back from the nip of the pair of register rollers, it is no longer possible to convey the delivered sheet member as desired despite the fact that the pair of register rollers are rotated.

SUMMARY OF THE INVENTION

A first object of the present invention is to provide an image-forming machine of a form in which the downstream end portion of a sheet member conveying passage extends, in a direction to separate away from one side wall of a housing, along and on the lower side of one side portion of an intermediate lower wall of the housing, wherein there is no need to form a considerable large space on the one side of the image-forming machine, there is no need to excessively increase the overall height of the image-forming machine, the downstream end portion of the sheet member conveying passage is opened, and hence the sheet members can be easily removed even when the sheet members are jammed at the downstream end portion in the sheet member conveying passage.

A second object of the present invention is to very easily mount a peeling agent application means on a predetermined position for applying a peeling agent onto one of the pair of fixing rollers, in addition to achieving the above-mentioned first object.

A third object of the present invention is to provide an image-forming machine of a form in which the upstream portion of a sheet member conveying passage is upwardly extending toward a pair of register rollers, wherein a sheet member that is delivered from a sheet member-feeding means and is brought at its leading edge into contact with the nip of a pair of register rollers, is reliably prevented from moving back from the pair of register rollers even when a rotary delivery member of the sheet member-feeding means is brought to a stop position where the non-acting surface thereof is opposed to the sheet member.

In order to achieve the above-mentioned first object according to the present invention, one side portion of an intermediate lower wall is defined by an opening/closing member that is so mounted as to freely move between a closed position and an open position which is upwardly turned from said closed position on a pivot axis extending substantially horizontally in the back-and-forth direction, and the downstream end portion of the sheet member conveying passage is opened when the opening/closing member is brought to the open position.

That is, in order to achieve the above-mentioned first object, the present invention provides an image-forming machine comprising a housing, a toner image carrier means disposed in said housing, a toner image-forming means for forming a toner image on said toner image carrier means, a sheet member conveying passage extending through a transfer zone and a fixing zone, a sheet member-feeding means for feeding a sheet member to said sheet member conveying passage, a sheet member conveying means for conveying the sheet members through said sheet member conveying passage, a sheet member-receiving means for receiving sheet members discharged from said sheet member conveying passage, a toner image transfer means for transferring the toner image formed on said toner image carrier means onto the sheet member in said transfer zone, and a toner image-fixing means for fixing the toner image onto the sheet member in said fixing zone; wherein said housing has a lower surface defined by an intermediate lower wall and an upper surface defined by an intermediate upper wall to form a space of which at least the front surface is at least partly opened;

said sheet member conveying passage extends upwardly from an upstream end to a downstream side of said fixing zone along and inside of one side wall of said housing, and then extends in a direction to separate away from said one side wall along and on the lower side of the one side portion of said intermediate lower wall through a curved portion;

said sheet member-receiving means is constituted by a portion of said intermediate lower wall that extends on the downstream side of said sheet member conveying passage; and said one side portion of said intermediate lower wall is defined by an opening/closing member that is so mounted as to freely move between a closed position and an open position upwardly turned from said closed position on a pivot axis extending substantially horizontally in the back-and-forth direction, and the downstream end portion of said sheet member conveying passage is opened when said opening/closing member is brought to said open position.

It is desired that said pivot axis be positioned at an upstream end portion of said one side portion of said intermediate lower wall as viewed in the direction of conveying the sheet members. It is desired to provide a locking means which releasably locks said opening/closing member at said closed position and at said open position.

In an embodiment for achieving the above-mentioned second object, said fixing means includes a pair of fixing rollers pushed toward each other and a peeling agent application means for applying a peeling agent onto one of said pair of fixing rollers, and said peeling agent application means is detachably mounted at a predetermined position through the downstream end portion of said sheet member conveying passage that is opened by bringing said opening/closing member to said open position. Said peeling agent application means includes a support member and an application member which is mounted on the lower surface of said support member and contains a liquid peeling agent, said peeling agent application means is attached or detached upon being moved in the up-and-down direction through the opened downstream end portion of said sheet member conveying passage, and when said peeling agent application means is mounted at said predetermined position, said application member is brought into contact with one peripheral surface of said pair of fixing rollers, and the upper surface of said support member defines the lower side of at least a portion of said downstream end portion of said sheet member conveying passage. According to a preferred embodiment, a to-be-contacted portion is formed on a front end portion and on a rear end portion of said support member in said peeling agent application means, a contact portion is formed on a front end portion and on a rear end portion of said opening/closing member, and when said opening/closing member is brought to said closed position, said contacting portions of said opening/closing members are brought into contact with said to-be-contacted portions of said support member, so that said peeling agent application means is limited to stay at said predetermined position.

According to a preferred embodiment, said one side wall of said housing includes an opening/closing member which freely moves between a closed position and an open position, and when said opening/closing member is brought to said open position, at least most of the portions are opened on the upstream side of said fixing zone in said sheet member conveying passage. A document reading means for reading a document is disposed above said intermediate upper wall.

In order to achieve the above-mentioned third object according to the present invention, a rotary delivery member in the sheet member-feeding means is rotated from a stop position where the non-acting surface is opposed to the uppermost sheet member when the pair of register rollers disposed in the sheet member conveying passage are at rest, so that the arcuate acting surface of the rotary deliver member acts on the uppermost sheet member to deliver the uppermost sheet member onto the sheet member conveying passage until its leading edge comes into contact with the nip of the pair of register rollers which are at rest, and then the pair of register rollers are preliminarily rotated for only a predetermined period of time while the arcuate acting surface of the rotary delivery member is acting on the uppermost sheet member such that the leading edge of the sheet member delivered to the sheet member conveying passage is nipped by the pair of register rollers, and the rotation of the rotary delivery member is stopped after it has turned once and has been brought to the stop position.

That is, in order to achieve the above-mentioned third object, the present invention provides an image-forming machine comprising a sheet member conveying passage, a sheet member-feeding means for feeding a sheet member to said sheet member conveying passage, a sheet member conveying means for conveying the sheet members through said sheet member conveying passage, and a control means; wherein said sheet member-feeding means is constituted by a sheet member accommodation means for accommodating sheet members in a stacked state, and a rotary delivery member for delivering the uppermost sheet member of the stacked sheet members to said sheet member conveying passage, said rotary delivery member having an arcuate acting surface that acts on the uppermost sheet member and a non-acting surface separated away from the uppermost sheet member;

said sheet member conveying means includes a pair of register rollers;

the upstream side of said pair of register rollers in said sheet member conveying passage upwardly extends toward said pair of register rollers; and said control means so works that a rotary delivery member is rotated from a stop position where the non-acting surface is opposed to the uppermost sheet member when said pair of register rollers are at rest, so that said arcuate acting surface of said rotary delivery member acts on the uppermost sheet member to deliver the uppermost sheet member to said sheet member conveying passage until its leading edge comes into contact with the nip of said pair of register rollers which are at rest, and then said pair of register rollers are preliminarily rotated for only a predetermined period of time while said arcuate acting surface of said rotary delivery member is acting on the uppermost sheet member such that the leading edge of the sheet member delivered to said sheet member conveying passage is nipped by said pair of register rollers, and the rotation of said rotary delivery member is stopped after it has turned once and is brought to said stop position, and then said pair of register rollers are rotated to convey the sheet member through said sheet member conveying passage.

According to a preferred embodiment, a sheet member detector is disposed on the upstream side of said pair of register rollers in said sheet member conveying passage, said control means preliminarily rotates said pair of register rollers for said predetermined period of time after the passage of a predetermined period of time from a moment that the leading edge of the sheet member delivered to said sheet member conveying passage was detected by said sheet member detector.

DETAILED DESCRIPTION OF THE PREFERRED EMBODIMENTS

Preferred embodiments of an image-forming machine constituted according to the present invention will now be described in further detail with reference to the accompanying drawings.

Figure 1:
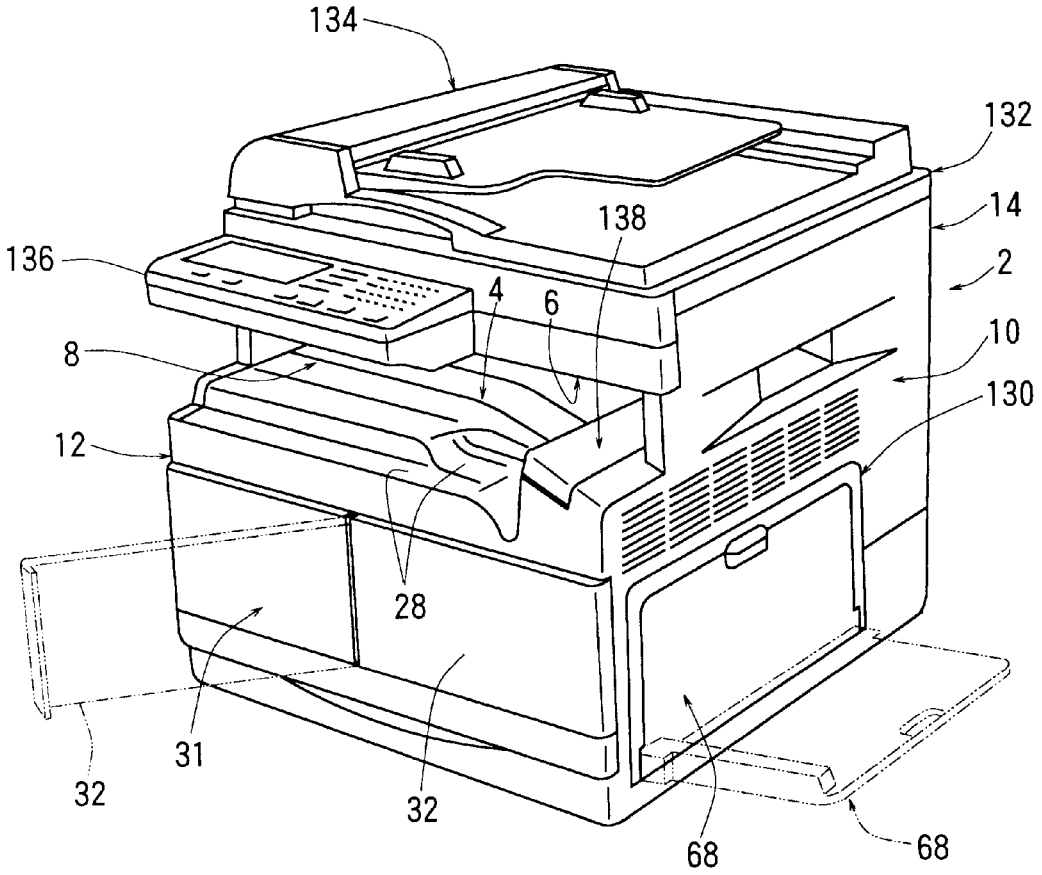
FIG. 1 is a perspective view illustrating a preferred embodiment of an image-forming machine constituted according to the present invention.
Figure 2:
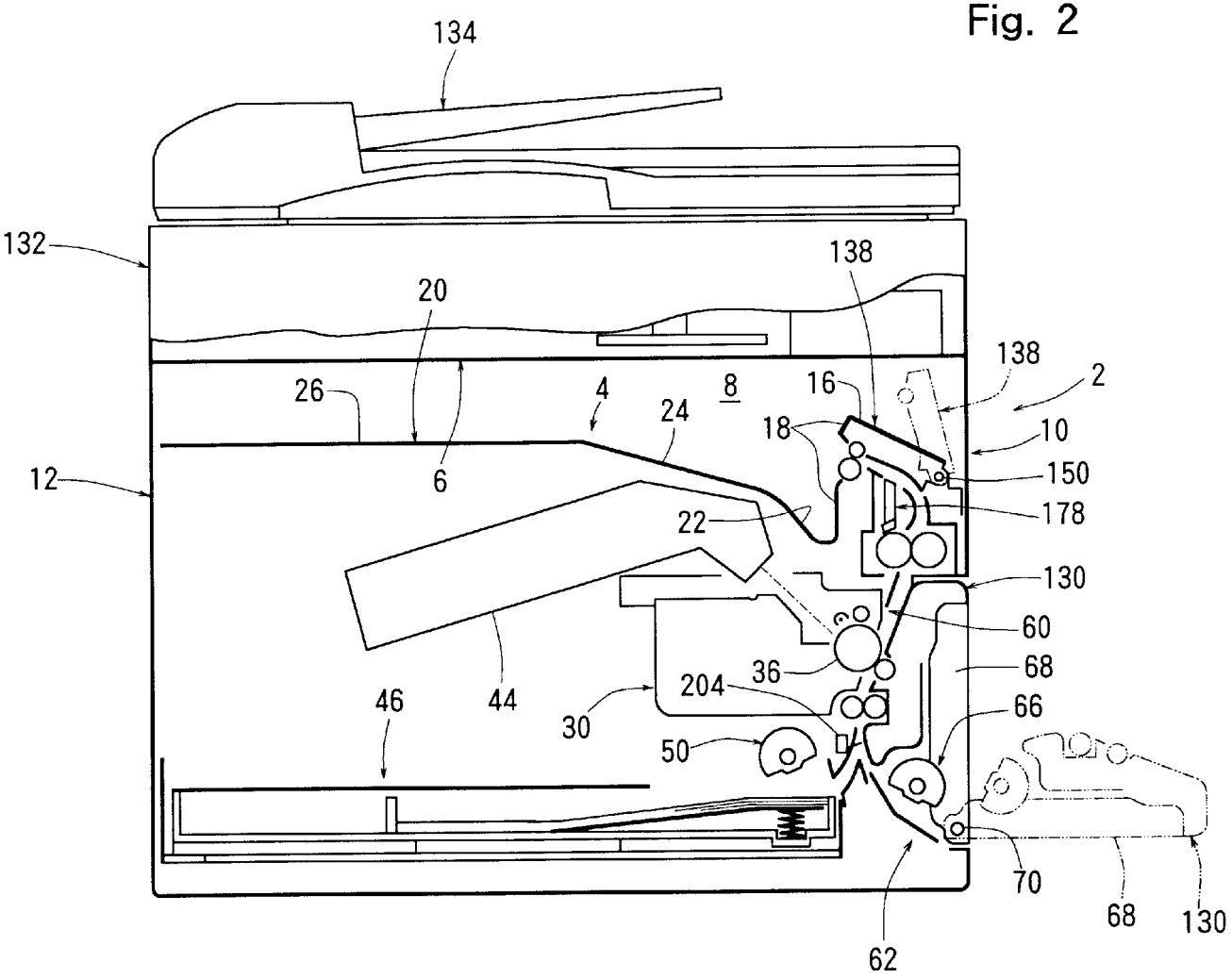
FIG. 2 is a sectional view schematically illustrating the image-forming machine of FIG. 1.

Referring to FIGS. 1 and 2, the image-forming machine is equipped with a housing of a nearly rectangular parallelopiped shape as generally designated at 2. At an intermediate portion of the housing 2 in the up-and-down direction, there are arranged an intermediate lower wall 4 and an intermediate upper wall 6 spaced at a distance in the up-and-down direction, and a space 8 is formed with its lower surface being defined by the intermediate lower wall 4 and its upper surface being defined by the intermediate upper wall 6. As will be understood with reference to FIG. 1, both side walls 10 and 12 of the housing 2 do not extend over the full width on both side surfaces of the space 8, but exist in the central portions only in the direction of width (direction perpendicular to the surface of the paper in FIG. 2). Therefore, both side surfaces of the space 8 are opened except the central portions in the direction of width. The back surface of the space 8 is entirely closed by a rear wall 14 of the housing 2. The front surface of the space 8, on the other hand, is entirely opened.

The intermediate lower wall 4 of the housing 2 includes one side surface of the housing 2, i.e., a tilted one side portion 16 upwardly extending being slightly tilted from the right side surface in FIG. 2, a hanging portion 18 downwardly extending nearly perpendicular to from the one side portion 16, and a main portion 20 extending from the lower end of the hanging portion 18 to the other side surface of the housing 2. The main portion 20 of the intermediate lower wall 4 constitutes a sheet member-receiving means (the sheet member-receiving means will be described later in further detail). The main portion 20 includes a first tilted portion 22 that upwardly extends in a tilted manner from the lower end of the hanging portion 18, a second tilted portion 24 that upwardly extends in a tilted manner continuing from the first tilted portion 22, and a horizontal portion 26 which extends substantially horizontally from the second tilted portion 24 to the other side surface of the housing 2. The tilted angle of the first tilted portion 22 is relatively large, and the tilted angle of the second tilted portion 24 is relatively small. As will be understood with reference to FIG. 1, a settled portion 28 is formed at the front ends of the second tilted portion 24 and of the horizontal portion 26. The intermediate upper wall 6 extends substantially horizontally over its full length.

Figure 3:
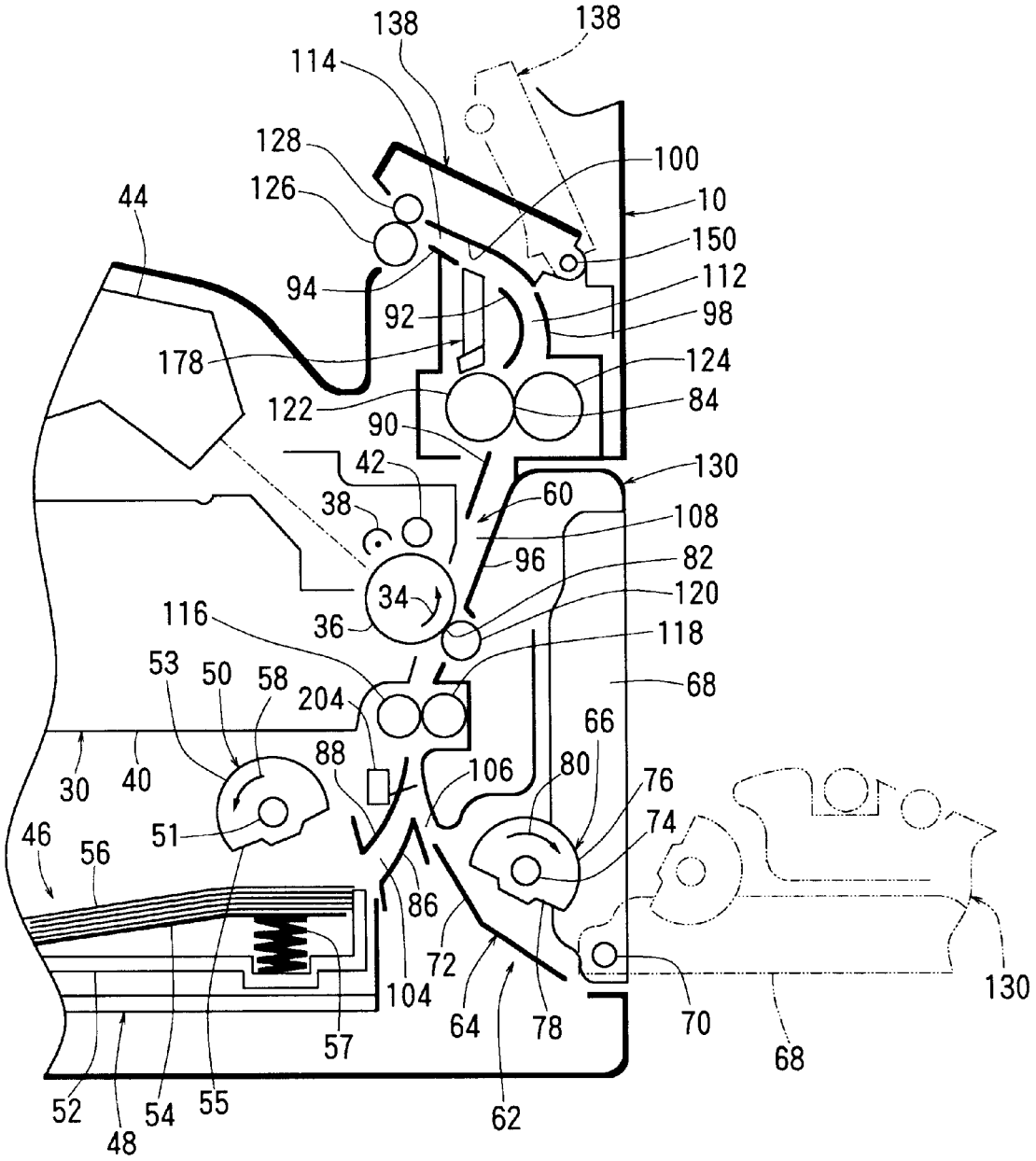
FIG. 3 is a partial sectional schematic view showing a sheet member conveying passage in the image-forming machine of FIG. 1.

With reference to FIGS. 2 and 3, a process unit 30 is detachably mounted in the housing 2. The process unit 30 is located under the intermediate lower wall 4. As shown in FIG. 1, a front wall 31 of the housing 2 includes an opening/closing member 32 which freely moves between a closed position indicated by solid lines and an open position indicated by two-dot chain lines. The process unit 30 is detachably mounted at a predetermined position in the housing 2 through an opening that is formed when the opening/closing member 32 is brought to the open position indicated by the two-dot chain lines. The process unit 30 includes a rotary drum 36 rotated in a direction indicated by an arrow 34, a corona discharger 38, a developing means 40 and a cleaning means 42. An electrostatic photosensitive material is disposed on the peripheral surface of the rotary drum 36. The rotary drum 36 constitutes a toner image carrier means, and a toner image is formed on the peripheral surface of the rotary drum 36, as will be described later. Inside the housing 2 is further disposed a laser beam irradiation means 44 in relation to the process unit 30.

A sheet member-feeding means 46 is disposed at a lower end of the housing 2. The sheet member-feeding means 46 is constituted by a sheet member accommodation means 48 in the form of a cassette, and a rotary delivery member 50. The sheet member accommodation means 48 includes a cassette container 52 which is detachably mounted at a predetermined position through an opening formed in the front wall 31 of the housing 2. A placing plate 54 is disposed in the cassette container 52, and plural sheet members 56 are placed in a stacked manner on the placing plate 54. A spring member 57 is disposed between the bottom wall of the cassette container 52 and the placing plate 54 to upwardly deflect the front end of the placing plate 54. The rotary delivery member 50 is secured to a rotary shaft 51. The rotary delivery member 50 is nearly of a semicircular shape, and has an arcuate acting surface 53 and a non-acting surface 55 of nearly the shape of a diameter. The rotary delivery member 50 having a relatively large width is secured to a rotary shaft 51. Or, instead, a plurality of rotary delivery members 50 may be secured to the rotary shaft 51 at suitable intervals. As will be described later in further detail, when a sheet member 56 is to be delivered from the sheet member-feeding means 46, the rotary delivery member 50 is rotated one turn in the direction indicated by an arrow 58 from a stop position that is shown, so that the arcuate acting surface 53 of the rotary delivery member 50 acts on the uppermost sheet member 56 of the stacked sheet members 56 accommodated in the sheet member accommodation means 48 and that uppermost sheet member 56 is delivered to a sheet member conveying passage 60.

Still referring to FIGS. 2 and 3, the illustrated image-forming machine further includes an additional sheet member-feeding means 62 in addition to the sheet member-feeding means 46. The sheet member-feeding means 62 is constituted by a sheet member accommodation means 64 and a rotary delivery member 66. The sheet member accommodation means 64 includes a support table 68 which is allowed to turn between a closed or non-acting position indicated by solid lines in FIGS. 1 to 3 and an open or acting position indicated by two-dot chain lines in FIGS. 1 to 3. The support table 68 is pivotably mounted on a support shaft 70 which extends in the back-and-forth direction substantially horizontally at a lower end in the housing 2 near one side surface of the housing 2. The sheet member accommodation means 64 further includes a support plate 72 disposed in the housing 2. When the support table 68 is brought to the acting position, the inner end of the support table 68 is located neighboring the support plate 72, enabling the stacked sheet members (not shown) to be placed on the support table 68 and on the support plate 72. The rotary delivery member 66 is secured to a rotary shaft 74. The rotary delivery member 66 is nearly of a semicircular shape, and has an arcuate acting surface 76 and a non-acting surface 78 of nearly the shape of a diameter, like the rotary delivery member 50 in the sheet member-feeding means 46. The rotary delivery member 66 which is relatively wide is secured to the rotary shaft 74. Or, instead, a plurality of rotary delivery members 66 may be secured onto the rotary shaft 74 at suitable intervals. As will be described later in further detail, when a sheet member is to be delivered from the sheet member-feeding means 62, the rotary delivery member 66 is rotated one turn in the direction indicated by an arrow 80 from a stop position that is shown, so that the arcuate acting surface 76 of the rotary delivery member 66 acts on the uppermost sheet member of the stacked sheet members accommodated in the sheet member accommodation means 64 and that uppermost sheet member is delivered to the sheet member conveying passage 60.

Further described with reference to FIGS. 2 and 3, the sheet member conveying passage 60 extends through a transfer zone 82 and a fixing zone 84. A guide plate 86 is disposed at an upstream end of the sheet member conveying passage 60. Guide plates 88, 90, 92 and 94 are disposed on one side of the sheet member conveying passage 60. On the other side of the sheet member conveying passage 60 are disposed guide plates 96 and 98, as well as a plurality of rib plates 100 (the rib plates 100 will be described later) positioned at intervals in the direction of width. The upstream end of the sheet member conveying passage 60 is branched into an introduction passage 104 and introduction passage 106, the introduction passage 104 being located close to the delivery end of the sheet member-feeding means 46, and the introduction passage 106 being located close to the delivery end of the sheet member-feeding means 62. A main portion 108 of the sheet member conveying passage 60 upwardly extends nearly vertically along the one side wall 10 of the housing 2 to the downstream side of the fixing zone 84 passing through the transfer zone 82 to the fixing zone 84. The sheet member conveying passage 60 includes a curved portion 112 that extends in a curved manner from the downstream side of the fixing zone 84, and a downstream end portion 114 that extends in a direction away from the one side wall 10, continuing from the curved portion 112. The downstream end portion 114 extends along and under the one side portion 16 of the intermediate lower wall 4, being slightly tilted upwards toward the downstream side.

A pair of register rollers 116 and 118 are arranged at a position slightly on the upstream side of the transfer zone 82 in the main portion 108 of the sheet member conveying passage 60. In the transfer zone 82 is disposed a transfer roller 120 that is opposed to the rotary drum 36. A pair of fixing rollers 122 and 124 are pushed toward each other with a required pressure produced by a suitable spring mechanism (not shown). In the fixing roller 122 is disposed a suitable heating means (not shown) which heats the peripheral surface of the fixing roller 122 to a desired temperature. Plural pairs of discharge rollers 126 and 128 (the discharge rollers 126 and 128 will be described later in further detail) are disposed at the downstream end of the sheet member conveying passage 60. The sheet member conveying means is constituted by the pair of register rollers 116 and 118, transfer roller 120, pair of fixing rollers 122 and 124, and plural pairs of discharge rollers 126 and 128. To convey the sheet member 56 through the sheet member conveying passage 60, the pair of register rollers 116 and 118, transfer roller 120, pair of fixing rollers 122 and 124, and pair of discharge rollers 126 and 128 are rotated in predetermined directions. As will be described later in further detail, the toner image on the rotary drum 36 is transferred onto the sheet member 56 by the action of the transfer roller 120 in the transfer zone 82. In the fixing zone 84, the toner image on the sheet member 56 is fixed onto the sheet member 56 by the action of the pair of fixing rollers 122 and 124. Therefore, the transfer roller 120 works as a sheet member conveying means and also as a transfer means, and the pair of fixing rollers 122 and 124 work as the sheet member conveying means and also as a fixing means.

Further described with reference to FIGS. 2 and 3, the one side wall 10 of the housing 2 includes an opening/closing member 130 which is mounted to turn between a closed position indicated by a solid line and an open position indicated by a two-dot chain line. The guide plate 96, register roller 118 and transfer roller 120 disposed along the sheet member conveying passage 60 are mounted on the opening/closing member 130. Furthermore, the rotary delivery member 66 in the sheet member-feeding means 62 is mounted on the opening/closing member 130. The opening/closing member 130 is pivotably mounted on the support shaft 70 on which is pivotably mounted the support table 68 in the sheet member-feeding means 62. As will be understood with reference to FIG. 1, the support table 68 that is brought to the closed position is surrounded by the opening/closing member 130, and becomes flush with the outer side surface of the opening/closing member 130. The support table 68, when brought to the closed position indicated by a solid line, is releasably locked to the opening/closing member 130 by a suitable locking mechanism (not shown). When the opening/closing member 130 is at the closed position, therefore, the support table 68 can be turned alone from the closed position to the open position. When both the opening/closing member 130 and the support table 68 are at the closed positions, however, the turn of the opening/closing member 130 to the open position causes the support table 68 to be turned to the open position along with the opening/closing member 130. A turn of the opening/closing member 130 to the open position is accompanied by the turn of the guide plate 96, register roller 118, transfer roller 120 and the rotary delivery member 66 in the sheet member-feeding means 62 and the support table 68 to the positions indicated by two-dot chain lines. Accordingly, almost all portions (substantially all portions excluding the introduction passage 104) on the upstream side of the fixing zone 84 in the sheet member conveying passage 86 are opened. In the event the sheet members 56 are jammed in a location on the upstream side of the fixing zone 84 in the sheet member conveying passage 60, therefore, the opening/closing member is turned to the open position, so that the jammed sheet members 56 can be removed very easily.

As clearly shown in FIGS. 1 and 2, a document reading means generally designated at 132 is disposed over the intermediate upper wall 6 of the housing 2. The illustrated document reading means 132 includes an automatic document conveying means 134. The document reading means 132 may be of a type well known among people skilled in the art, and is, hence, not described in this specification. A protruded portion 136 of nearly a rectangular parallelopiped shape is formed on the front surface of the housing 2 just above the intermediate upper wall 6. On the upper surface of the protruded portion 136 are arranged various manual operation buttons, keys and display means.

The manner of forming an image on the illustrated image-forming machine will be briefly described with reference to FIGS. 2 and 3. The rotary drum 36 having the electrostatic photosensitive material disposed on the peripheral surface thereof is rotated in a direction indicated by arrow 34. The corona discharger 38 uniformly charges the electrostatic photosensitive material to a predetermined polarity. Then, as indicated by a dot-dash chain line, the electrostatic photosensitive material is selectively irradiated with a laser beam from laser beam irradiation means 44 according to an image that is to be formed. Thus, an electrostatic latent image is formed on the peripheral surface of the rotary drum 36. Thereafter, the electrostatic latent image is developed into a toner image by the developing means 40. Sheet members 56 are fed onto the sheet member conveying passage 60 from the sheet member-feeding means 48 (or 62), and are conveyed through the transfer zone 82 and the fixing zone 84. In the transfer zone 82, the surface of the sheet member 56 is brought into intimate contact with the peripheral surface of the rotary drum 36 by the action of the transfer roller 120, and the toner image on the peripheral surface of the rotary drum 36 is transferred onto the sheet member 56. The cleaning means 42 removes the residual toner from the peripheral surface of the rotary drum 36 after the image has been transferred. As the sheet member 56 passes through the fixing zone 84, the toner image is fixed onto the sheet member 56 by the action of the pair of fixing rollers 122 and 124. The sheet member 56 having the toner image fixed thereon is discharged from the sheet member conveying passage 60 onto a sheet member-receiving means, i.e., onto the main portion 20 of the intermediate lower wall 4 through a discharge port formed in the hanging portion 18 of the intermediate lower wall 4. The main portion 20 of the intermediate lower wall 4 includes a first tilted portion 22 and a second tilted portion 24 that are upwardly tilted toward the downstream side (toward the left in FIG. 2). Therefore, the sheet member 56 completely discharged from the sheet member conveying passage 60 is so trimmed that the trailing edge thereof is located at the upstream end of the first tilted portion 22 due to its own weight. The settled portion 28 that is formed at the front ends of the second tilted portion 24 and of the horizontal portion 26 in the main portion 20 of the intermediate lower wall 4, therefore allow inserting fingers beneath the lower surface side of the discharged sheet member 56. Accordingly, the discharged sheet member 56 can be very easily gripped and pulled forward.

The above-mentioned constitutions and actions of the illustrated image-forming machine do not constitute novel and improved features of the present invention. In the illustrated image-forming machine constituted according to the present invention, the following improvements have been made.

The downstream end portion of the sheet member conveying passage is opened

Figure 4:
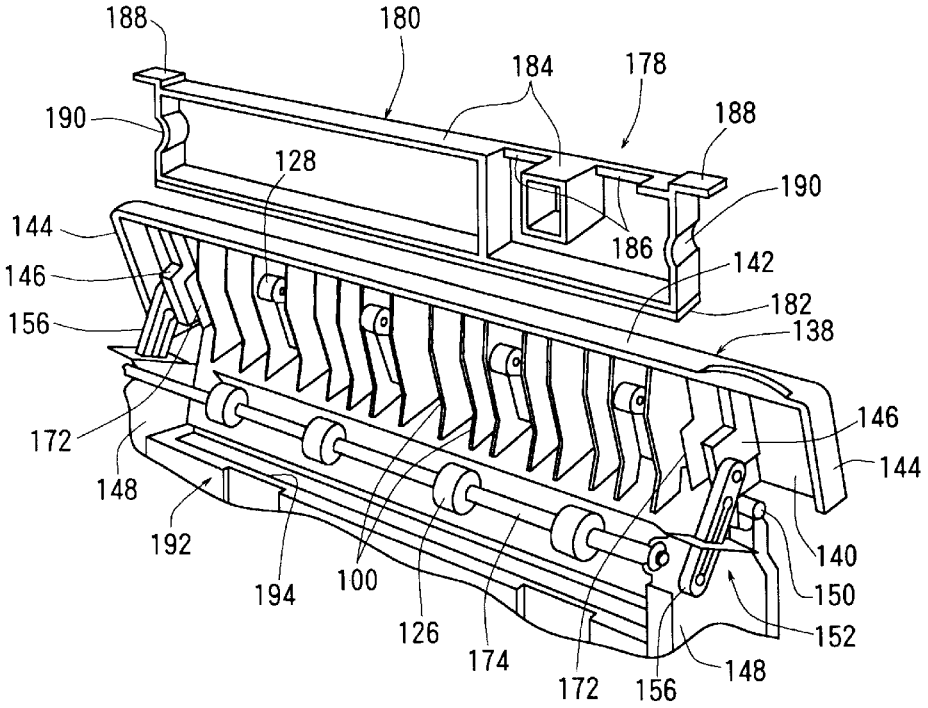
FIG. 4 is a partial perspective view illustrating the downstream end portion of the sheet member conveying passage in the image-forming machine of FIG. 1.

As seen with reference to FIGS. 1 to 3 together with FIG. 4, the tilted one side portion 16 of the intermediate lower wall 4 of the housing 2 of the illustrated image-forming machine, is defined, together with the upper end of the hanging portion 18, by an opening/closing member 138 that is mounted to freely move between the closed position indicated by solid lines in FIGS. 1 to 3 and the open position indicated by two-dot chain lines in FIGS. 2 and 3 and indicated by solid lines in FIG. 4. As clearly shown in FIG. 4, the opening/closing member 138, which can be made of a suitable synthetic resin, includes a top plate portion 140, a front plate portion 142 hanging down from the end of the top plate portion 140, and two side plate portions 144 hanging down from both side edges of the top plate portion 140. The top plate portion 140 defines the one side portion 16 of the intermediate lower wall 4, and the front plate portion 142 defines the upper end portion (more specifically, the portion on the upper side of the discharge opening in the sheet member conveying passage 60) of the hanging portion 18 of the intermediate lower wall 4. Mounting arms 146 are formed on both side portions of the inner surface, i.e., of the lower surface of the top plate portion 140. A pair of upright support plates 148 are secured in the housing 2 at a distance in the direction of width (direction perpendicular to the surface of the paper in FIG. 2). The mounting arms 146 of the opening/closing member 138 are each pivotably mounted to the upright support plates 148 via mounting pins 150. Accordingly, the opening/closing member 138 is pivotably mounted to freely pivot on the center axis of the mounting pins 150. As will be clearly understood with reference to FIGS. 2 and 3, the two mounting pins 150 (and hence their center axes) extend in the back-and-forth direction substantially horizontally in the upstream end portion of the one side portion 16 of the intermediate lower wall 4 defined by the top plate portion 140 of the opening/closing member 138.

Figure 5:
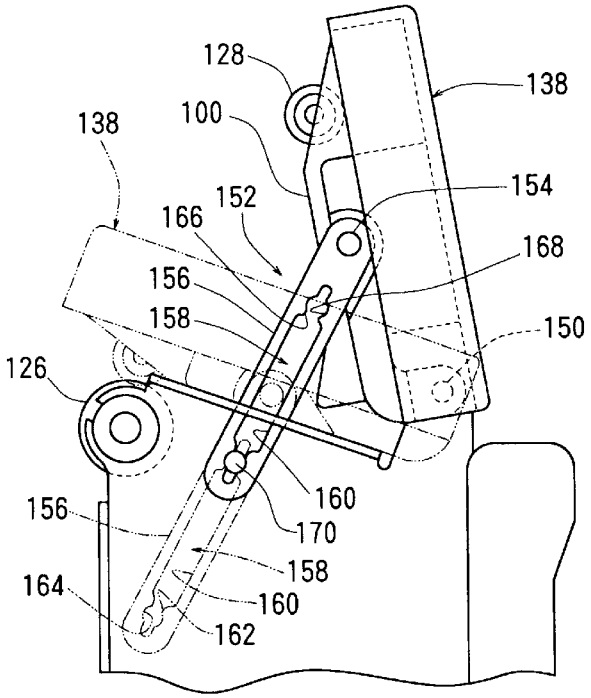
FIG. 5 is a partial side view illustrating the downstream end portion of the sheet member conveying passage in the image-forming machine of FIG. 1.

Further described with reference to FIGS. 4 and 5, the opening/closing member 138 is provided with a locking means 152 which releasably locks the pivoting motion at the closed position indicated by solid lines in FIGS. 1 to 3 and by two-dot chain lines in FIG. 5 and releasably locks the pivoting motion at the open position indicated by two-dot chain lines in FIGS. 1 to 3 and indicated by solid lines in FIGS. 4 and 5. The locking means 152 will be described in further detail. Locking members 156 are pivotably mounted on the mounting arms 146 via coupling pins 154 extending substantially horizontally. A guide slot 158 that extends in an elongated manner is formed in each of the locking members 156 which can be made of a suitable synthetic resin. As clearly shown in FIG. 5, the guide slot 158 has a guide portion 160, as well as an open locking portion 164, connected to one end of the guide portion 160 through a narrow portion 162, and a closed locking portion 168, connected to the other end of the guide portion 160 through a narrow portion 166. Locking pins 170 that extend substantially horizontally are mounted on the upright support plates 148 disposed in the housing 2, and are inserted in the guide slots 158 formed in the locking members 156. The locking pins 170 have a diameter which is substantially the same as the width of the guide portions 160 of the guide slots 158, and are the same as the diameters of the open locking portions 164 and of the closed locking portions 168, and is slightly larger than the widths of the narrow portions 162 and 166. When the opening/closing member 138 is pivoted, the locking members 156 move with the opening/closing member 138, whereby the locking pins 170 relatively move in the guide slots 158 of the locking members 156. As the opening/closing member 138 is pivoted to the open position, the locking pin 170 causes the narrow portion 162 to be elastically deformed, passes therethrough, and is positioned in the open locking portion 164. As the locking pin 170 is locked by the narrow portion 162 as described above, the opening/closing member 138 is releasably locked at the open position. When the opening/closing member 138 is pivoted to the closed position, the locking pin 170 causes the narrow portion 166 to be elastically deformed, passes therethrough and is positioned in the closed locking portion 168. As the locking pin 170 is locked by the narrow portion 166, the opening/closing member 138 is releasably locked at the closed position.

Further described with reference to FIG. 4, at each end of the inner surface of the top plate portion 140 of the opening/closing member 138, there are further formed plate-like contact portions 172 (the action of the contact portions 172 will be described later) that are positioned on the inside of the mounting arms 146. The above-mentioned plural rib plates 100 are formed at suitable intervals between the contact portions 172. On the inner surface of the top plate portion 140 of the guide member 138, the above-mentioned discharge rollers 128 are rotatably mounted at a suitable intervals in the direction of width via a suitable mounting member. A rotary shaft 174 that extends substantially horizontally is rotatably mounted between the pair of upright support plates 148 disposed in the housing 2, and the above-mentioned four discharge rollers 126 are secured to the rotary shaft 174 so as to be corresponded to the above-mentioned four discharge rollers 128. The rotary shaft 174 is connected to an electric motor via a suitable transmission means (not shown).

As will be clearly understood with reference to FIGS. 1 to 4, when the opening/closing member 138 is at the closed position, the rib plates 100 define the upper side of the downstream end portion of the sheet member conveying passage 60, and the discharge rollers 128 are pushed toward the discharge rollers 126. Therefore, when the rotary shaft 174 is driven to rotate the discharge rollers 126, the discharge rollers 128 are driven correspondingly, whereby the sheet member 56 is conveyed through the downstream end portion of the sheet member conveying passage 60 and is discharged from the sheet member conveying passage 60. On the other hand, when the opening/closing member is pivoted to the open position, the rib plates 100 and the discharge rollers 128 are separated from the sheet member conveying passage 60, and the downstream end portion of the sheet member conveying passage 60 is opened. In case any sheet members 56 are jammed in the downstream end portion of the sheet member conveying passage 60, therefore, the opening/closing member 138 is pivoted to the open position and the downstream end portion of the sheet member conveying passage 60 is opened, so that the jammed sheet members 56 can be taken out very easily. The opening/closing member 138 is brought to the open position by pivoting upwards on the pivot axis (center axis of the mounting pins 150) separately from the opening/closing member 130 which works to open the portion on the upstream side of the fixing zone 84 in the sheet member conveying passage 60. Therefore, no additional space needs be made on the right side of the housing 2 in FIG. 2 in order to move the opening/closing member 138 to the open position. In order to take out the sheet members 56 jammed in the downstream end portion of the sheet member conveying passage 60, the opening/closing member 138 needs not be turned up to a state in which it extends substantially vertically but may be turned to an open position indicated by two-dot chain lines in FIGS. 2 and 3 and indicated by solid lines in FIG. 4. Accordingly, the intermediate upper wall 6 need not be upwardly and excessively separated from the intermediate lower wall 4, and hence the height of the image-forming machine need not be excessively increased.

Peeling agent application means

With reference to FIGS. 2 and 3 together with FIG. 4, in the illustrated image-forming machine is disposed a peeling agent application means 178 for applying a peeling agent such as a silicone oil onto the peripheral surface of one fixing roller 122 of the pair of fixing rollers 122 and 124. The peeling agent application means 178 is constituted by a support member 180 and an application member 182. The support member 180 is made of a suitable synthetic resin. An upper central portion 184 of the support member 180 is formed flat (in the illustrated embodiment, the upper central portion 184 is not of a substantially rectangular flat surface but has a notch 186 for avoiding interference with various members (not shown) mounted between the pair of upright support plates 148 when mounted at a predetermined position). To-be-contacted portions 188 are formed at both ends of the upper surface, i.e., at the front end and at the rear end of the support member 180, the to-be-contacted portions 188 slightly extending upward and then protruding outward in the direction of width from the upper central portion 184. Furthermore, engaging recessed portions 190 are formed in both side surfaces of the support member 180. The lower surface of the support member 180 is substantially of a rectangular shape and is flat. The application member 182 is constituted by a felt piece extending in an elongated manner and is adhered to the lower surface of the support member 180 via a suitable adhesion means such as a double-side adhesive tape. The application member 182 is impregnated with a peeling agent which may be a silicone oil.

Referring to FIG. 4, a receiving member 192 is secured between the pair of upright support plates 148 secured in the housing 2. A mounting opening 194 of nearly a rectangular shape is formed in the receiving member 192 to correspond to the outer shape of a portion of the support member 180 of the peeling agent application means 178 excluding the to-be-contacted portions 188. Such a mounting opening 194 extends vertically through receiving member 192, and engaging protrusions (not shown) are formed on both side walls thereof.

As will be easily understood with reference to FIG. 4, when the opening/closing member 138 is brought to the open position to open the downstream end portion of the sheet member conveying passage 60, the mounting opening 194 of the receiving member 192 is exposed. The peeling agent application means 178 is inserted in the mounting opening 194 in the receiving member 192 from the upper side and is mounted therein. When the peeling agent application means 178 is mounted at a predetermined position, the application member 182 downwardly protrudes beyond the mounting opening 194 and is brought into contact with the peripheral surface of the fixing roller 122. Furthermore, the engaging protrusions (not shown) formed on both side walls of the mounting opening 194 engage with the engaging recessed portions 190 formed in both side surfaces of the support member 180, so that the peeling agent application means 178 is engaged at the predetermined position. Then, as the opening/closing member 138 is turned to the closed position, the plate-like contact portions 172 formed at the front end and the rear end of the opening/closing member 138 come into contact with the to-be-contacted portions 188 of the support member 180, whereby the peeling agent application means 178 is limited to stay at the predetermined position and is reliably prevented from being upwardly displaced. As will be easily understood with reference to FIG. 4 together with FIGS. 2 and 3, the upper central portion 184 of support member 180 of the peeling agent application means 178 defines part of the lower side of the downstream end portion of the sheet member conveying passage 60, and the rib plates 100 formed on the opening/closing member 138 are positioned over the upper central portion 184 of the support member 180 at a predetermined distance to define the upper side of the downstream end portion of the sheet member conveying passage 60.

When the peeling agent contained in the application member 182 of the peeling agent application means 178 is depleted, the peeling agent application means 178 is renewed in a manner as described below. That is, the opening/closing member 138 is brought to the open position to open the downstream end portion of the sheet member conveying passage 60, the peeling agent application means 178 is upwardly taken out through the mounting opening 194 of the receiving member 192, the new peeling agent application means 178 is mounted in the mounting opening 194 of the receiving member 192, and the opening/closing member 138 is brought to the closed position. The peeling agent application means 178 can be replaced very easily and quickly.

Controlling the supply of sheet members

Figure 6:
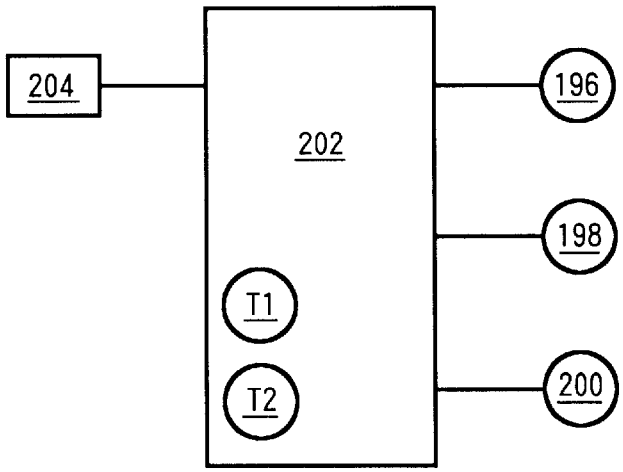
FIG. 6 is a block diagram illustrating control elements related to controlling the supply of sheet members in the image-forming machine of FIG. 1.

Next, described below is how to control the supply of sheet members in the illustrated image-forming machine. With reference to FIGS. 2 and 3 together with FIG. 6, a common electric motor (not shown) is connected to the rotary delivery member 50 in the sheet member-feeding means 46 via a clutch means 196 (FIG. 6), is connected to the rotary delivery member 66 in the sheet member-feeding means 62 via a clutch means 198 (FIG. 6), and is connected to the register roller 116 of the pair of register rollers 116 and 118 via a clutch means 200. The clutch means 196, 198 and 200 are controlled by a control means 202 which may be a microprocessor. Referring to FIG. 2, a sheet member detector 204 which may be a microswitch is disposed on the upstream side of the pair of register rollers 116 and 118 in the sheet member conveying passage 60, and the output signal of the sheet member detector 204 is sent to the control means 202.

Figure 7:
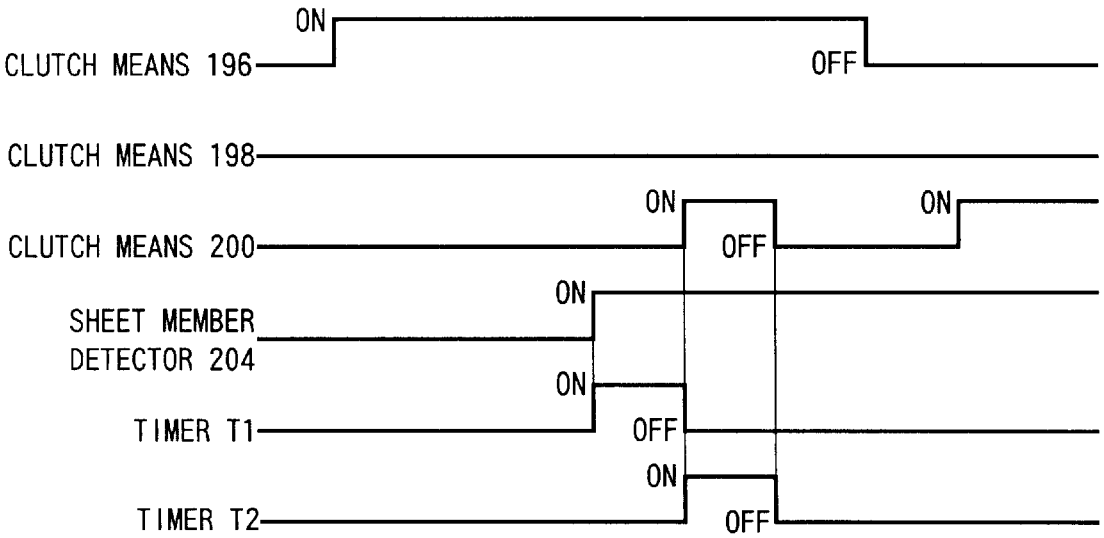
FIG. 7 is a time chart illustrating the operation of the control elements related to controlling the supply of sheet members in the image-forming machine of FIG. 1.
Figure 8:
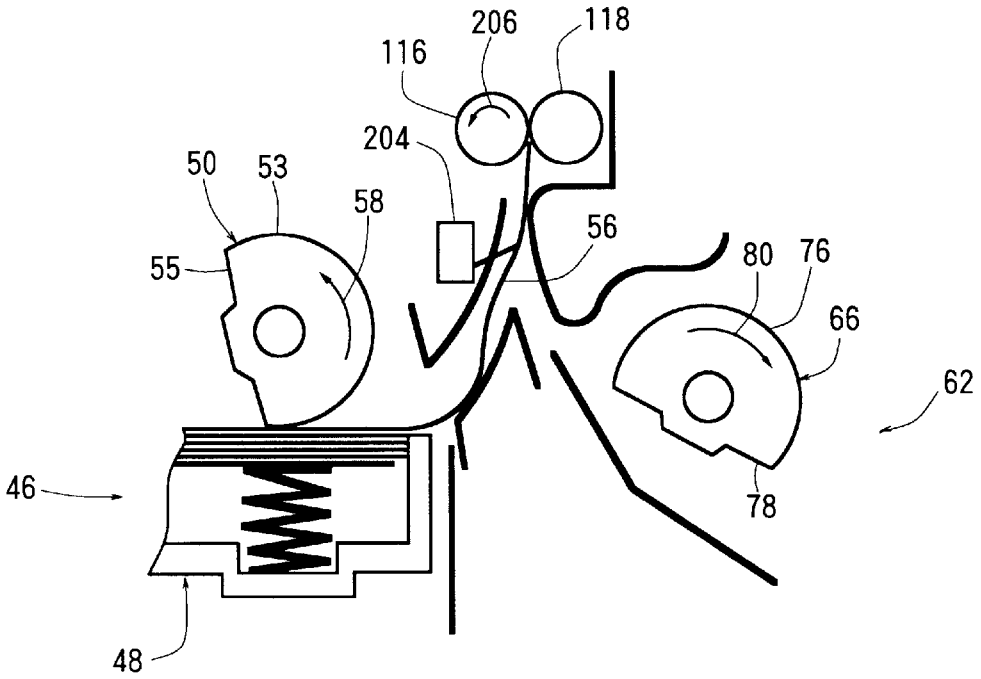
FIG. 8 is a partial sectional view schematically illustrating a mode for controlling the supply of sheet members just prior to preliminarily rotating a pair of register rollers for feeding sheet member in the image-forming machine of FIG. 1.
Figure 9:
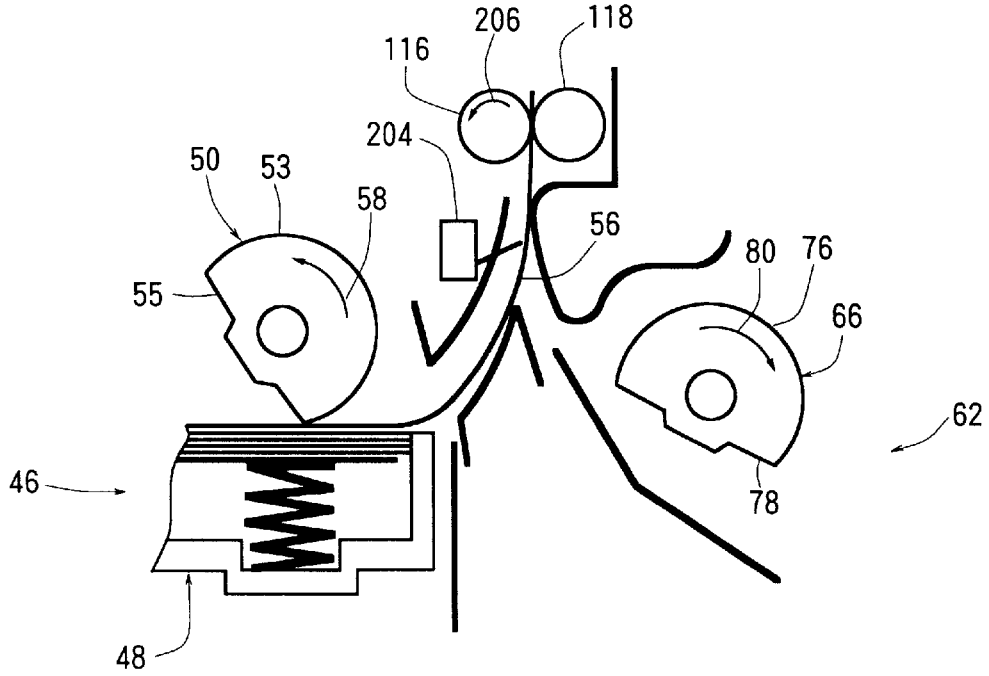
FIG. 9 is a partial sectional view schematically illustrating a mode for controlling the supply of sheet members after the pair of register rollers are preliminarily rotated for feeding sheet member in the image-forming machine of FIG. 1.

With reference to FIGS. 2 and 3 together with FIGS. 6 through 9, when a feed signal is sent to the control means 202 instructing that a sheet member be delivered from the sheet member-feeding means 46 to the sheet member conveying passage 60, the clutch means 196 is operated and the rotary delivery member 50 is rotated in the direction indicated by arrow 58 from the stop position shown in FIG. 3. When the rotary delivery member 50 is rotated through a predetermined angle, the acting surface 53 of the rotary delivery member 50 acts upon the uppermost sheet member 56 of the stacked sheet members 56 held in the sheet member accommodation means 48, so that the uppermost sheet member 56 is delivered to the sheet member conveying passage 60. Referring to FIG. 8, the delivered sheet member 56 is brought to a position at which its leading edge is in contact with the nip of the pair of register rollers 116 and 118 which are at rest, and is slightly curved on the upstream side of the pair of register rollers 116 and 118. Even when the sheet member 56 is delivered to the sheet member conveying passage 60 with its leading edge being slightly skewed, the leading edge of the sheet member 56 is brought into contact with the nip of the pair of register rollers 116 and 118 which are at rest, and the tilted state of the leading edge of the sheet member 56 is properly corrected.

As will be comprehended from FIG. 7, when the sheet member 56 delivered to the sheet member conveying passage 60 is detected by the sheet member detector 204, a timer T1 contained in the control means 202 starts counting the time. When the timer T1 counts a predetermined period of time, a timer T2 contained in the control means 202 starts counting the time, and the clutch means 200 is actuated, causing the pair of register rollers 116 and 118 to be preliminarily turned in the direction indicated by arrow 206. At this moment as shown in FIG. 8, the acting surface 53 of the rotary delivery member 50 of the sheet member-feeding means 46 is still acting on the sheet member 56. When the timer T2 counts a predetermined period of time, the clutch means 200 is returned back to the non-acting state, and the preliminary turn of the pair of register rollers 116 and 118 is stopped. When the pair of register rollers 116 and 118 are preliminarily turned for only a predetermined period of time counted by the timer T2, the leading edge of the sheet member 56 that had been brought into contact with the nip of the pair of register rollers 116 and 118, is then nipped by the pair of register rollers 116 and 118. Then, as the rotary delivery member 50 of the sheet member-feeding means 46 turns once and arrives again at the stop position shown in FIG. 3, the clutch means 196 is placed in the non-acting state, and the rotary delivery member 50 is no longer rotated. Thereafter, the clutch means 200 is operated as desired in synchronism with the rotation of the rotary drum 36, the pair of register rollers 116 and 118 start rotating, and the sheet member 56 is conveyed through the transfer zone 82 and the fixing zone 84 in the sheet member conveying passage 60.

When a feed signal is sent to the control means 202 instructing that a sheet member be delivered from the sheet member-feeding means 62 to the sheet member conveying passage 60, the clutch means 198 is actuated instead of the clutch means 196, and the rotary delivery member 66 is rotated, instead of the rotary delivery member 50, in the direction indicated by arrow 80 from the stop position shown in FIG. 3. The pair of register rollers 116 and 118 are preliminarily rotated and the rotary delivery member 66 is stopped in the same manner as is the rotary delivery member 50 when the sheet member 56 is delivered from the sheet member-feeding means 46.

In controlling the supply of sheet members as described above, attention should be given to the following facts. In the illustrated image-forming machine, the sheet member conveying passage 60 is upwardly extending nearly vertically from the upstream end thereof to the nip of the pair of register rollers 116 and 118. In this case, the rotary delivery member 50 may continue to rotate until its acting surface 53 no longer acts upon the sheet member 56 and the sheet member 56 may no longer be delivered by the acting surface 53 of the rotary delivery member 50 in a state where the pair of register rollers 116 and 118 are not preliminarily rotated, the leading edge of the sheet member 56 delivered to the sheet member conveying passage 60 is not nipped by the pair of register rollers 116 and 118, but the leading edge is simply brought into contact with the nip of the pair of register rollers 116 and 118. Then, it could happen that the sheet member 56 that is upwardly extending nearly vertically along the sheet member conveying passage 60, slightly moves back due to its own weight, and hence the leading edge of the sheet member 56 tends to separate away to some extent from the nip of the pair of register rollers 116 and 118. With the leading edge of the sheet member 56 separated away even by a small amount from the nip of the pair of register rollers 116 and 118, the sheet member 56 is no longer conveyed as desired by the pair of register rollers 116 and 118 despite the pair of register rollers 116 and 118 being rotated in synchronism with the rotation of the rotary drum 36. In controlling the supply of sheet members in a manner as described above, however, the pair of register rollers 116 and 118 are preliminarily rotated for only a predetermined period of time after the leading edge of the sheet member 56 is brought into contact with the nip of the pair of register rollers 116 and 118 but before the rotary delivery member 50 has rotated until its acting surface 53 no longer acts upon the sheet member 56, so that the leading edge of the sheet member 56 is nipped by the pair of register rollers 116 and 118. Accordingly, the delivered sheet member 56 is not moved back even when the rotary delivery member 50 has rotated until its acting surface 53 no longer acts on the sheet member 56.

A preferred embodiment of the image-forming machine constituted according to the present invention was described above in detail with reference to the accompanying drawings. It should, however, be noted that the present invention is in no way limited to the above-mentioned embodiment only but can be changed or modified in a variety of ways without departing from the scope of the invention.

What we claim is:

1. An image-forming machine comprising a housing, toner image carrier means disposed in said housing, toner image-forming means for forming a toner image on said toner image carrier means, means defining a sheet member conveying passage extending through a transfer zone and a fixing zone, sheet member-feeding means for feeding a sheet member to said sheet member conveying passage, sheet member conveying means for conveying the sheet member through said sheet member conveying passage, sheet member-receiving means for receiving the sheet member when discharged from said sheet member conveying passage, toner image transfer means for transferring the toner image formed on said toner image carrier means onto the sheet member in said transfer zone, and toner image-fixing means for fixing the toner image onto the sheet member in said fixing zone; wherein:

said housing has a lower surface defined by an intermediate lower wall and an upper surface defined by an intermediate upper wall to form a space of which at least the front surface is at least partly opened;

said sheet member conveying passage upwardly extends from an upstream end to a downstream end on a downstream side of said fixing zone along and inside of one side wall of said housing, and then extends in a direction away from said one side wall along and on the upper side of one side portion of said intermediate lower wall through a curved portion;

said sheet member-receiving means is constituted by a portion of said intermediate lower wall that extends on the downstream side of said sheet member conveying passage;

said one side portion of said intermediate lower wall is defined by an opening/closing member that is so mounted as to freely move between a closed position and an open position upwardly turned from said closed position on a pivot axis extending substantially horizontally in the back-and-forth direction of said housing as a center, and the downstream end portion of said sheet member conveying passage is opened when said opening/closing member is brought to said open position; and said toner image fixing means includes a pair of fixing rollers pushed toward each other and a peeling agent application means for applying a peeling agent onto one of said pair of fixing rollers, and said peeling agent application means is detachably mounted at a predetermined position through the downstream end portion of said sheet member conveying passage that is opened by bringing said opening/closing member to said open position.

2. An image-forming machine according to claim 1, wherein a pivot axis is positioned at an upstream end portion of said one side portion of said intermediate lower wall as viewed in a direction of conveying the sheet member for pivoting thereabout of said opening/closing member between said closed position and said open position.

3. An image-forming machine according to claim 1, further comprising locking means disposed to releasably lock said opening/closing member alternatively at said closed position and at said open position.

4. An image-forming machine according to claim 1, wherein said peeling agent application means includes a support member and an application member which is mounted on the lower surface of said support member and contains a liquid peeling agent, said peeling agent application means is attached at said predetermined position or detached from said predetermined position by being moved in the up-and-down direction through the opened downstream end portion of said sheet member conveying passage when said opening/closing member is in said open position, and when said peeling agent application means is mounted at said predetermined position, said application member is in contact with the peripheral surface of one of said pair of fixing rollers, and the upper surface of said support member defines the lower side of at least a portion of said downstream end portion of said sheet member conveying passage.

5. An image-forming machine according to claim 4, wherein a to-be-contacted portion is formed on a front end portion and on a rear end portion of said support member in said peeling agent application means, a contact portion is formed on a front end portion and on a rear end portion of said opening/closing member, and when said opening/closing member is in said closed position, said contacting portions of said opening/closing member contact said to-be-contacted portions of said support member, so that said peeling agent application means is limited to stay at said predetermined position.

6. An image-forming machine according to claim 1, wherein said one side wall of said housing includes a second opening/closing member which freely moves between a closed position and an open position, and when said second opening/closing member is brought to its open position, at least most of the upstream side of said fixing zone in said sheet member conveying passage is opened.

7. An image-forming machine according to claim 1, further comprising reading means disposed above said intermediate upper wall by reading documents.

* * * * *